US011154905B2

(12) United States Patent
Lindemann

(10) Patent No.: US 11,154,905 B2
(45) Date of Patent: Oct. 26, 2021

(54) ADAPTIVE LOCALIZATION OF VIBRATIONAL ENERGY IN A SYSTEM WITH MULTIPLE VIBRATIONAL TRANSDUCERS

(71) Applicant: Cirrus Logic International Semiconductor Ltd., Edinburgh (GB)

(72) Inventor: Eric Lindemann, Boulder, CO (US)

(73) Assignee: Cirrus Logic, Inc., Austin, TX (US)

( * ) Notice: Subject to any disclaimer, the term of this patent is extended or adjusted under 35 U.S.C. 154(b) by 456 days.

(21) Appl. No.: 16/263,286

(22) Filed: Jan. 31, 2019

(65) Prior Publication Data

US 2019/0255567 A1 Aug. 22, 2019

Related U.S. Application Data

(60) Provisional application No. 62/632,803, filed on Feb. 20, 2018.

(51) Int. Cl.

| | |
|---|---|
| ***H04R 25/00*** | (2006.01) |
| ***B06B 1/06*** | (2006.01) |
| ***H04R 3/04*** | (2006.01) |
| ***H04R 9/04*** | (2006.01) |

(52) U.S. Cl.

CPC ..... *B06B 1/0622* (2013.01); *H04R 3/04* (2013.01); *H04R 9/046* (2013.01)

(58) Field of Classification Search

CPC ..... B06B 1/0622; H04R 3/04; H04R 9/046

USPC ..... 381/333, 334

See application file for complete search history.

(56) References Cited

U.S. PATENT DOCUMENTS

2019/0037165 A1* 1/2019 Lee ..... H01L 51/00

* cited by examiner

*Primary Examiner* — Ammar T Hamid

(74) *Attorney, Agent, or Firm* — Jackson Walker L.L.P.

(57) ABSTRACT

A system may include a vibrating surface, a first mechanical transducer mechanically coupled to the vibrating surface, a second mechanical transducer mechanically coupled to the vibrating surface at a location different than that of the first mechanical transducer, a first signal path for driving the first mechanical transducer, wherein the first signal path comprises a first amplifier and a first filter having a first frequency response, a second signal path for driving the second mechanical transducer, wherein the second signal path comprises a second amplifier and a second filter having a second frequency response, and a control subsystem. The control subsystem may include an analysis block configured to cross-correlate a first vibrational energy at a first location of the vibrating surface with a second vibrational energy at a second location of the vibrating surface and a coefficient control block configured to adaptively modify at least one of the first frequency response and the second frequency response responsive to cross-correlation of the first vibrational energy and the second vibrational energy in order to maximize differences between the first vibrational energy and the second vibrational energy.

24 Claims, 5 Drawing Sheets

ADAPTIVE LOCALIZATION OF VIBRATIONAL ENERGY IN A SYSTEM WITH MULTIPLE VIBRATIONAL TRANSDUCERS

RELATED APPLICATION

The present disclosure claims priority to U.S. Provisional Patent Application Ser. No. 62/632,803, filed Feb. 20, 2018, which is incorporated by reference herein in its entirety.

FIELD OF DISCLOSURE

The present disclosure relates in general to a mobile device, and more particularly, to using one or more mechanical transducers to drive a display to generate audio and one or more other mechanical transducers to drive the display to establish localized audio quiet zones.

BACKGROUND

In surface audio applications, a vibrational transducer, such as a piezoelectric actuator or electromagnetic voice coil, is mechanically coupled to a surface such as the screen or body of a smartphone, tablet, personal computer, or other device. The vibrational transducer may, in response to an input signal received by the vibrational transducer, generate vibrational energy to vibrate the surface to generate sound. In some instances, it may be desirable to control an area on the surface in which vibration occurs. For example, in the case of a smartphone, a portion of the vibrating surface may be used as an earpiece receiver. Accordingly, it may be desirable that a portion of the surface intended to be nearest the ear during a phone call vibrate while suppressing vibration at other areas of the surface in order to minimize acoustic leakage from the smartphone. As another example, in the case of a stereo surface audio system in which two vibrational transducers are located at different locations of the surface and cause acoustic vibrations, it may be desirable that interference between these vibrations at these different locations be minimized Thus, systems and methods for optimally localizing vibration on a surface may be desired.

SUMMARY

In accordance with the teachings of the present disclosure, the disadvantages and problems associated with localizing surface-generated audio with a mobile device may be reduced or eliminated.

In accordance with embodiments of the present disclosure, a system may include a vibrating surface, a first mechanical transducer mechanically coupled to the vibrating surface, a second mechanical transducer mechanically coupled to the vibrating surface at a location different than that of the first mechanical transducer, a first signal path for driving the first mechanical transducer, wherein the first signal path comprises a first amplifier and a first filter having a first frequency response, a second signal path for driving the second mechanical transducer, wherein the second signal path comprises a second amplifier and a second filter having a second frequency response, and a control subsystem. The control subsystem may include an analysis block configured to cross-correlate a first vibrational energy at a first location of the vibrating surface with a second vibrational energy at a second location of the vibrating surface and a coefficient control block configured to adaptively modify at least one of the first frequency response and the second frequency response responsive to cross-correlation of the first vibrational energy and the second vibrational energy in order to maximize differences between the first vibrational energy and the second vibrational energy.

In accordance with these and other embodiments of the present disclosure, a method may include cross-correlating a first vibrational energy at a first location of a vibrating surface with a second vibrational energy at a second location of the vibrating surface and adaptively modifying at least one of a first frequency response and a second frequency response responsive to cross-correlation of the first vibrational energy and the second vibrational energy in order to maximize differences between the first vibrational energy and the second vibrational energy. The first frequency response may be that of a first filter integral to a first signal path for driving a first mechanical transducer mechanically coupled to the vibrating surface, the first signal path comprising a first amplifier and the first filter. The second frequency response may be that of a second filter integral to a second signal path for driving a second mechanical transducer mechanically coupled to the vibrating surface at a location different than that of the first mechanical transducer, the second signal path comprising a second amplifier and the second filter.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
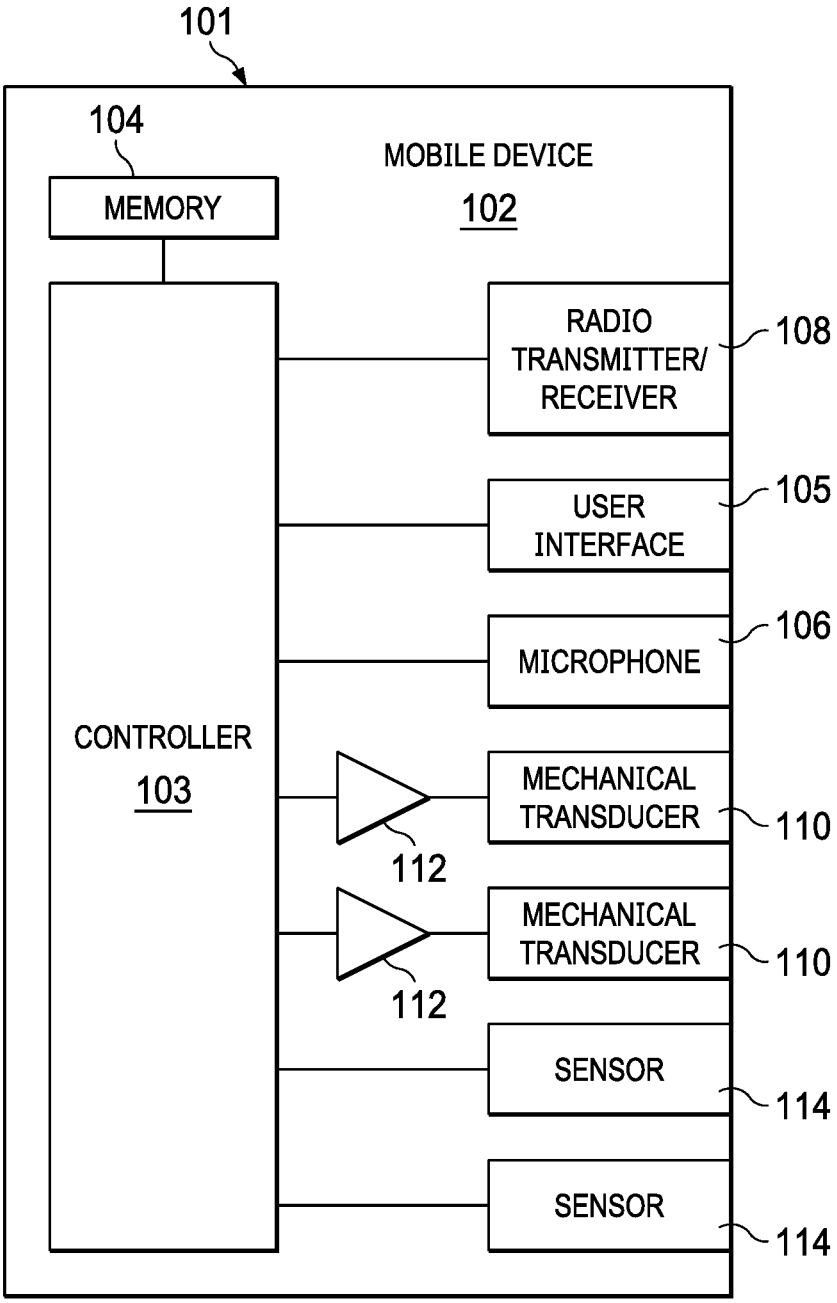
FIG. 1A illustrates a block diagram of selected components of an example mobile device, in accordance with embodiments of the present disclosure.

FIG. 1A illustrates a block diagram of selected components of an example mobile device 102, in accordance with embodiments of the present disclosure. As shown in FIG. 1A, mobile device 102 may comprise an enclosure 101, a controller 103, a memory 104, a user interface 105, a microphone 106, a radio transmitter/receiver 108, a plurality of mechanical transducers 110, a plurality of amplifiers 112, and a plurality of sensors 114.

Enclosure 101 may comprise any suitable housing, casing, or other enclosure for housing the various components of mobile device 102. Enclosure 101 may be constructed from plastic, metal, and/or any other suitable materials. In addition, enclosure 101 may be adapted (e.g., sized and shaped) such that mobile device 102 is readily transported on a person of a user of mobile device 102. Accordingly, mobile device 102 may include but is not limited to a smart phone, a tablet computing device, a handheld computing device, a personal digital assistant, a notebook computer, or any other device that may be readily transported on a person of a user of mobile device 102.

Controller 103 is housed within enclosure 101 and may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 103 may interpret and/or execute program instructions and/or process data stored in memory 104 and/or other computer-readable media accessible to controller 103.

Memory 104 may be housed within enclosure 101, may be communicatively coupled to controller 103, and may include any system, device, or apparatus configured to retain program instructions and/or data for a period of time (e.g., computer-readable media). Memory 104 may include random access memory (RAM), electrically erasable programmable read-only memory (EEPROM), a Personal Computer Memory Card International Association (PCMCIA) card, flash memory, magnetic storage, opto-magnetic storage, or any suitable selection and/or array of volatile or non-volatile memory that retains data after power to mobile device 102 is turned off.

User interface 105 may be housed at least partially within enclosure 101, may be communicatively coupled to controller 103, and may comprise any instrumentality or aggregation of instrumentalities by which a user may interact with mobile device 102. For example, user interface 105 may permit a user to input data and/or instructions into mobile device 102 (e.g., via a keypad and/or touch screen), and/or otherwise manipulate mobile device 102 and its associated components. User interface 105 may also permit mobile device 102 to communicate data to a user, e.g., by way of a display device.

Microphone 106 may be housed at least partially within enclosure 101, may be communicatively coupled to controller 103, and may comprise any system, device, or apparatus configured to convert sound incident at microphone 106 to an electrical signal that may be processed by controller 103, wherein such sound is converted to an electrical signal using a diaphragm or membrane having an electrical capacitance that varies as based on sonic vibrations received at the diaphragm or membrane. Microphone 106 may include an electrostatic microphone, a condenser microphone, an electret microphone, a microelectromechanical systems (MEMs) microphone, or any other suitable capacitive microphone.

Radio transmitter/receiver 108 may be housed within enclosure 101, may be communicatively coupled to controller 103, and may include any system, device, or apparatus configured to, with the aid of an antenna, generate and transmit radio-frequency signals as well as receive radio-frequency signals and convert the information carried by such received signals into a form usable by controller 103. Radio transmitter/receiver 108 may be configured to transmit and/or receive various types of radio-frequency signals, including without limitation, cellular communications (e.g., 2G, 3G, 4G, LTE, etc.), short-range wireless communications (e.g., BLUETOOTH), commercial radio signals, television signals, satellite radio signals (e.g., GPS), Wireless Fidelity, etc.

A mechanical transducer 110 may be housed at least partially within enclosure 101 or may be external to enclosure 101, may be communicatively coupled to controller 103 (e.g., via a respective amplifier 112), and may comprise any system, device, or apparatus made with one or more materials configured to generate electric potential or voltage when mechanical strain is applied to mechanical transducer 110, or conversely to undergo mechanical displacement or change in size or shape (e.g., change dimensions along a particular plane) when a voltage is applied to mechanical transducer 110. In some embodiments, a mechanical transducer may comprise a piezoelectric transducer made with one or more materials configured to, in accordance with the piezoelectric effect, generate electric potential or voltage when mechanical strain is applied to mechanical transducer 110, or conversely to undergo mechanical displacement or change in size or shape (e.g., change dimensions along a particular plane) when a voltage is applied to mechanical transducer 110.

In some embodiments, mechanical transducer 110 may comprise a voice coil and magnet structure. When an electrical signal is applied to the voice coil, a magnetic field is created by the electric current in the voice coil, making it a variable electromagnet. The coil and the driver's magnetic system interact, generating a mechanical force that causes the coil (and thus, the attached surface) to move back and forth, thereby reproducing sound under the control of the applied electrical signal coming from an amplifier.

A sensor 114 may comprise any suitable system, device, or apparatus configured to sense vibrational energy proximate to a mechanical transducer 110 and generate a signal indicative of such vibrational energy. For example, in some embodiments, a sensor 114 may comprise an accelerometer configured to measure an acceleration and generate a signal indicative of such measured acceleration.

Although specific example components are depicted above in FIG. 1A as being integral to mobile device 102 (e.g., controller 103, memory 104, user interface 105, microphone 106, radio transmitter/receiver 108, mechanical transducers 110, amplifiers 112, and sensors 114), a mobile device 102 in accordance with this disclosure may comprise one or more components not specifically enumerated above.

Figure 1B:
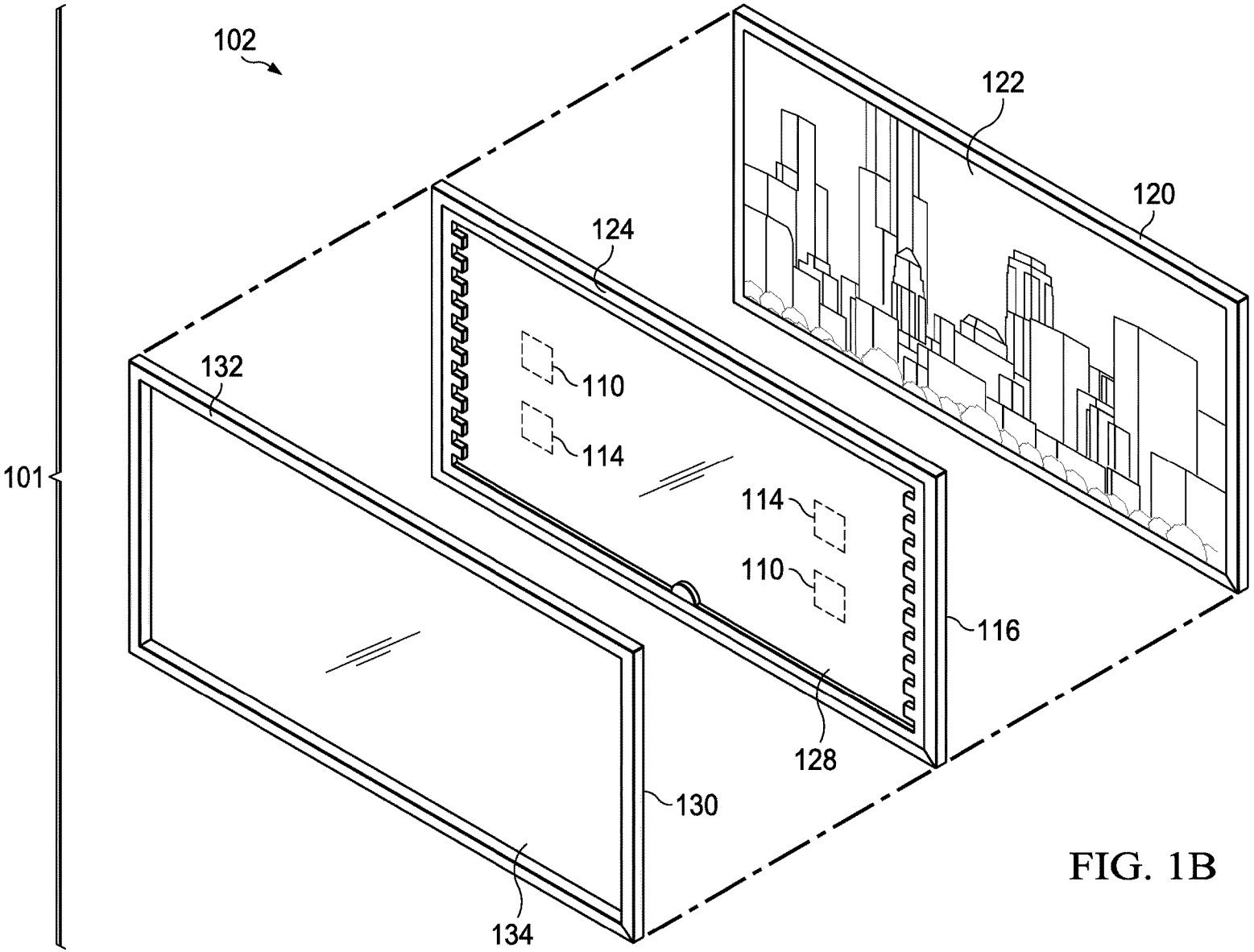
FIG. 1B illustrates an exploded perspective view of selected components of an example mobile device, in accordance with embodiments of the present disclosure.

FIG. 1B illustrates an exploded perspective view of selected components of example mobile device 102, in accordance with embodiments of the present disclosure. As shown in FIG. 1B, enclosure 101 may include a main body 120, a mechanical transducer assembly 116, and a cover assembly 130, such that when constructed, mechanical transducer assembly 116 is interfaced between main body 120 and cover assembly 130. Main body 120 may house a number of electronics, including controller 103, memory 104, radio transmitter/receiver 108, and/or microphone 106, as well as a display (e.g., a liquid crystal display) of user interface 105.

Mechanical transducer assembly 116 may comprise a frame 124 configured to hold and provide mechanical structure for one or more mechanical transducers 110 (which may be coupled to controller 103), one or more sensors 114 (which may be coupled to controller 103), and transparent film 128.

Cover assembly 130 may comprise a frame 132 configured to hold and provide mechanical structure for transparent cover 134. Transparent cover 134 may be made from any suitable material (e.g., ceramic) that allows visibility through transparent cover 134, protection of mechanical transducer 110 and display 122, and/or user interaction with display 122.

Figure 2A:
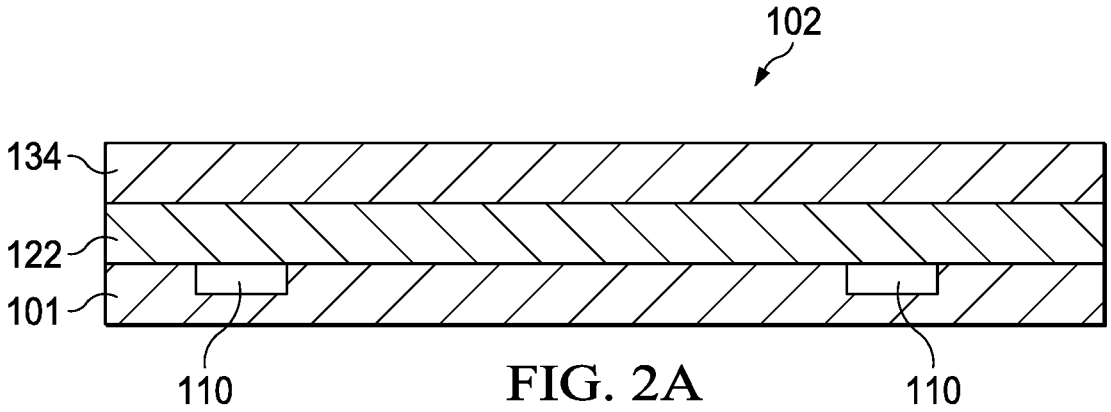
FIG. 2A illustrates a side elevation view of selected components of an example mobile device, in accordance with embodiments of the present disclosure.
Figure 2B:
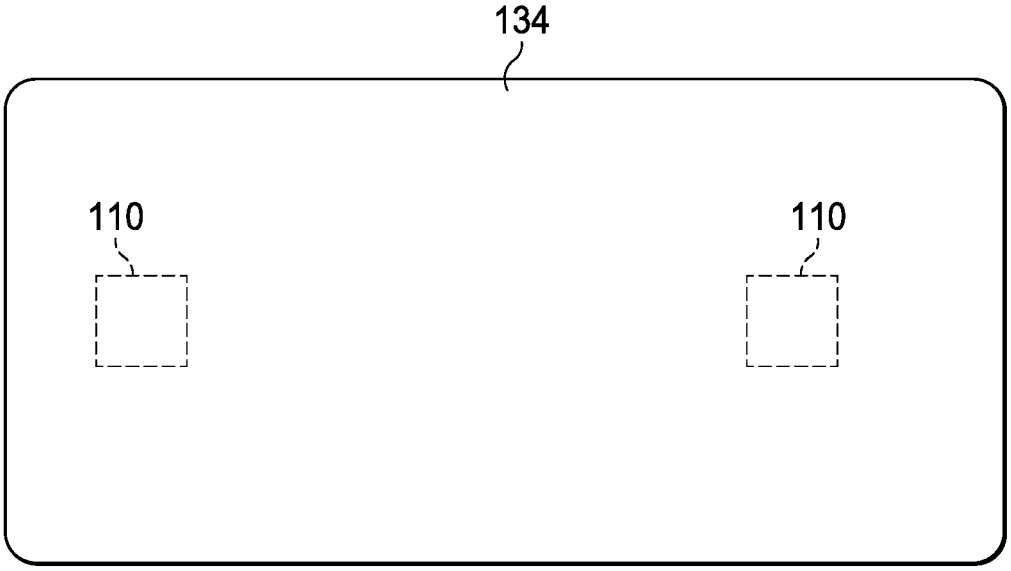
FIG. 2B illustrates a top plan view of selected components of an example mobile device, in accordance with embodiments of the present disclosure.

Although FIG. 1B illustrates mechanical transducer assembly 116 being situated between cover assembly 130 and display 122, in some embodiments, mechanical transducer assembly 116 may reside "behind" display 122, such that display 122 is situated between cover 130 and mechanical transducer assembly 116. In addition, although FIG. 1B illustrates mechanical transducers 110 and sensors 114 located at particular locations within mechanical transducer assembly 116, mechanical transducers 110 and sensors 114 may be located at any suitable location below transparent cover 134 and/or display 122 (e.g., underneath transparent cover 134 and/or display 122 from a perspective of a user viewing display 122). For example, FIG. 2A illustrates a side elevation view of selected components of another embodiment of example mobile device 102, in accordance with embodiments of the present disclosure, while FIG. 2B illustrates a top plan view of selected components of example mobile device 102, in accordance with embodiments of the present disclosure.

In addition, although FIG. 1B depicts mechanical transducers 110 present within mechanical transducer assembly 116 and capable of inducing vibration on cover 130 or display 122, in some embodiments, mechanical transducers 110 may be placed proximate to main body 120 and may be capable of causing a suitable surface of main body 120 to vibrate in order to generate sound. Consequently, sensors 114 may also be placed within or proximate to main body 120 to sense vibrational energy caused by mechanical transducers 110.

Although FIGS. 1A-2B depict certain numbers of mechanical transducers 110 (e.g., two mechanical transducers 110 in FIGS. 1A and 1B and two mechanical transducers 110 in FIGS. 2A and 2B), mobile device 102 may include any suitable number of mechanical transducers 110.

Mechanical transducers, including piezoelectric transducers and coil-based dynamic transducers, are typically used to convert electric signals into mechanical force. Thus, when used in connection with display 122, transparent cover 134, and/or main body 120, one or more mechanical transducers 110 may cause vibration on a surface, which in turn may produce pressure waves in air, generating human-audible sound. Accordingly, in operation of mobile device 102, one or more mechanical transducers 110 may be driven by respective amplifiers 112 under the control of controller 103 in order to generate acoustical sound by vibrating the surface of display 122, transparent cover 134, and/or main body 120.

However, while sensors 114 are shown as separate from mechanical transducers 110 in FIG. 1A, in some embodiments, a sensor 114 may be a part of or otherwise integral to a mechanical transducer 110. To illustrate, mechanical transducers, including piezoelectric transducers and coil-based dynamic transducers, may also function in reverse to that described above, such that mechanical force applied to a mechanical transducer 110 may result in the mechanical transducer generating an electrical signal indicative of the mechanical force applied.

Accordingly, in accordance with the systems and methods disclosed herein, mobile device 102 may comprise a plurality of mechanical transducers 110 driving a common surface (e.g., display 122, transparent cover 134, main body 120), wherein one or more of the mechanical transducers 110 may drive the common surface in order to generate human-audible sound, and one or more of other mechanical transducers 110 may be used as sensors 114, converting a measure of mechanical energy local to such sensor mechanical transducers 110—which may be indicative of an undesired displacement or mechanical vibration of the surface—into electrical signals (e.g., voltages) indicative of the undesired displacement or mechanical vibration of the surface. Further, the electrical signals produced by a mechanical transducer 110 acting as a sensor may be received by controller 103, which may implement a control circuit to inject a cancelling signal (e.g., scaled amounts of drive current from a synthesized high-impedance source) to mechanically control the mechanical transducer 110 acting as a sensor to cancel out the undesired displacement or mechanical vibration of the surface, resulting in a reduced mechanical (and hence reduced acoustic) output in a local area specific to the mechanical transducer 110 acting as a sensor.

While only two mechanical transducers 110 may be necessary to implement such a system (e.g., one mechanical transducer 110 driving a surface at one location and another mechanical transducer sensing and cancelling in another location of the surface), the use of multiple transducers 110 may lead to greater cancellation and localized control of cancellation, while also enabling different "active" acoustic areas on mobile device 102 in applications in which such flexibility is desirable.

Figure 3A:
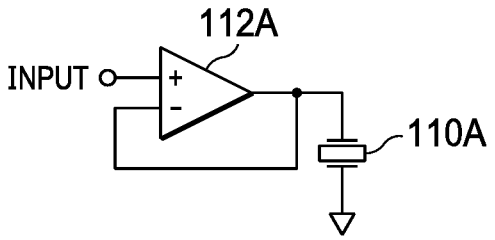
FIG. 3A illustrates a circuit diagram of an example amplifier and piezoelectric transducer for generating acoustical sound via a surface, in accordance with embodiments of the present disclosure.

FIG. 3A illustrates a circuit diagram of an example amplifier 112A and a mechanical transducer implemented as a piezoelectric transducer 110A for generating acoustical sound via a surface, in accordance with embodiments of the present disclosure. As shown in FIG. 3A, amplifier 112A, which may be configured as a voltage-controlled voltage source, may receive an input signal and generate an appropriate output signal based on the input signal in order to drive piezoelectric transducer 110A directly, or in some cases such as when a Class D or switching amplifier is used, via a matching/filter network. In turn, piezoelectric transducer 110A may be mechanically coupled to a surface (e.g., display 122, transparent cover 134, and/or main body 120), and may cause mechanical movement/vibration of such surface in order to generate acoustical sound.

Figure 3B:
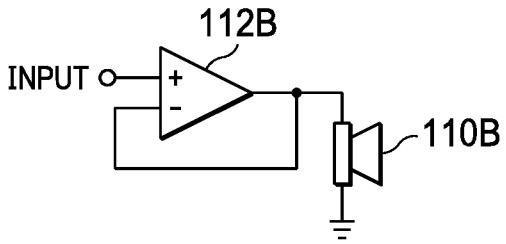
FIG. 3B illustrates a circuit diagram of an example amplifier and coil-based dynamic transducer for generating acoustical sound via a surface, in accordance with embodiments of the present disclosure.

FIG. 3B illustrates a circuit diagram of an example amplifier 112B and a mechanical transducer implemented as a coil-based dynamic transducer 110B for generating acoustical sound via a surface, in accordance with embodiments of the present disclosure. As shown in FIG. 3B, amplifier 112B, which may be configured as a voltage-controlled voltage source, may receive an input signal and generate an appropriate output signal based on the input signal in order to drive coil-based dynamic transducer 110B directly, or in some cases such as when a Class D or switching amplifier is used, via a matching/filter network. In turn, coil-based dynamic transducer 110B may be mechanically coupled to a surface (e.g., display 122, transparent cover 134, and/or main body 120), and may cause mechanical movement/vibration of such surface in order to generate acoustical sound.

Figure 4:
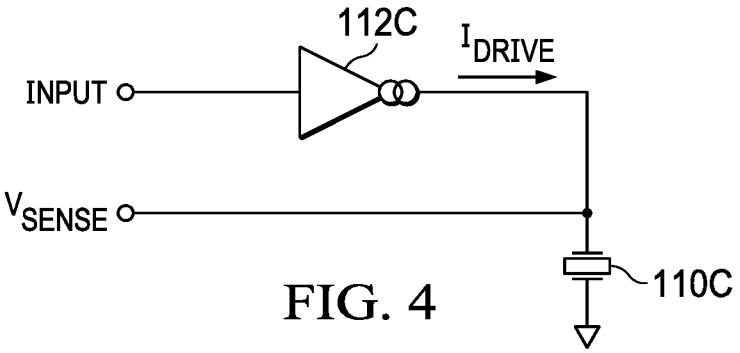
FIG. 4 illustrates a circuit diagram of an example amplifier and mechanical transducer for sensing mechanical energy generated by the mechanical transducer, in accordance with embodiments of the present disclosure.

FIG. 4 illustrates a circuit diagram of an example amplifier 112C and mechanical transducer 110C for actively sensing mechanical energy (e.g., at a surface) generated by mechanical transducer 110C, in accordance with embodiments of the present disclosure. In operation, mechanical transducer 110C may generate a voltage VSENSE across its terminals in response to mechanical displacement/vibration of mechanical transducer 110C. Voltage VSENSE may be sensed by an appropriate circuit (e.g., controller 103). Amplifier 112C, which may comprise a voltage-controlled current source, may generate a driving current IDRIVE as a function of input voltage INPUT in order to generate a desired vibrational energy surface proximate to mechanical transducer 110C.

Figure 5:
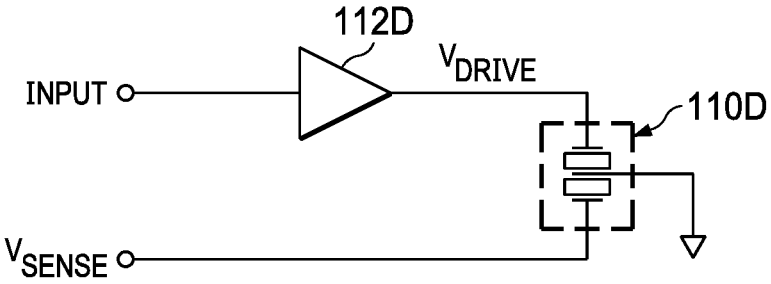
FIG. 5 illustrates a circuit diagram of another example amplifier and another mechanical transducer for sensing mechanical energy generated by the mechanical transducer, in accordance with embodiments of the present disclosure.

FIG. 5 illustrates a circuit diagram of an example amplifier 112D and mechanical transducer 110D for actively sensing mechanical energy (e.g., at a surface) generated by mechanical transducer 110D, in accordance with embodiments of the present disclosure. As shown in FIG. 5, mechanical transducer 110D may comprise a three-terminal device, such that one layer of mechanical transducer 110D may be used for driving mechanical movement while another layer of mechanical transducer 110D may be used for sensing mechanical movement. In operation, mechanical transducer 110D may generate a voltage VSENSE as shown in FIG. 5 in response to mechanical displacement/vibration of mechanical transducer 110D. Voltage VSENSE may be sensed by an appropriate circuit (e.g., controller 103). Amplifier 112D, which may comprise a voltage-controlled voltage source, may generate a driving voltage VDRIVE as a function of input voltage INPUT in order to generate a desired vibrational energy surface proximate to mechanical transducer 110D.

Figure 6:
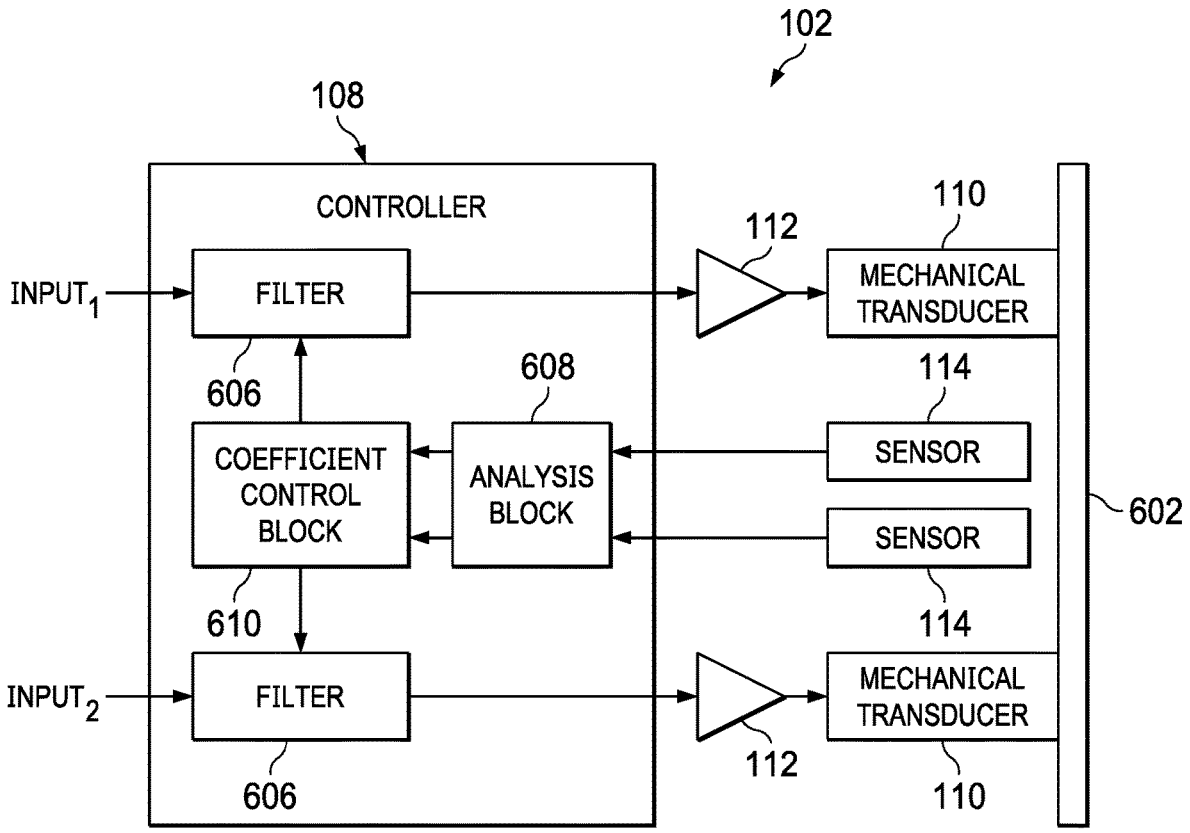
FIG. 6 illustrates selected portions of a mobile device including detail of selected components of a controller, in accordance with embodiments of the present disclosure.

FIG. 6 illustrates selected portions of mobile device 102 including detail of selected components of controller 103, in accordance with embodiments of the present disclosure. As shown in FIG. 6, mobile device 102 may include a vibrating surface 602 (e.g., display 122, transparent cover 134, and/or main body 120), with a first mechanical transducer 110 mechanically coupled to vibrating surface 602 and a second mechanical transducer 110 mechanically coupled to vibrating surface 602 at a location different than that of the first mechanical transducer 110. Mobile device 102 may also include a first signal path for driving the first mechanical transducer 110, wherein the first signal path comprises a first amplifier 112 and a first filter 606 (e.g., implemented by controller 103) having a first frequency response with a variable gain and variable phase, wherein the first filter 606 may filter an input signal $INPUT_1$ and output a filtered version of input signal $INPUT_1$ to amplifier 112 of the first signal path. Mobile device 102 may also include a second signal path for driving the second mechanical transducer 110, wherein the second signal path comprises a second amplifier 112 and a second filter 606 (e.g., implemented by controller 103) having a second frequency response with a variable gain and variable phase, wherein the second filter 606 may filter an input signal $INPUT_2$ and output a filtered version of input signal $INPUT_2$ to amplifier 112 of the first signal path. Controller 103 may also implement a control subsystem having an analysis block 608 and a coefficient control block 610. Analysis block 608 may be configured to cross-correlate a first vibrational energy at a first location (e.g., location proximate to first sensor 114) of vibrating surface 602 with a second vibrational energy at a second location (e.g., location proximate to first second 114) of vibrating surface 602. Coefficient control block 610 may be configured to adaptively modify at least one of the first frequency response (e.g., by modifying filter coefficients of the first filter 606) and the second frequency response (e.g., by modifying filter coefficients of the second filter 606) responsive to the cross-correlation of the first vibrational energy and the second vibrational energy in order to maximize differences between the first vibrational energy and the second vibrational energy. For example, in some embodiments, maximizing differences between the first vibrational energy and the second vibrational energy may include maximizing a magnitude of the first vibrational energy and minimizing a magnitude of the second vibrational energy, as is the case when a portion of vibrating surface 602 is to be used as a telephone earpiece. As another example, in other embodiments, maximizing differences between the first vibrational energy and the second vibrational energy may include minimizing a cross-correlation between the first vibrational energy and the second vibrational energy, as is the case when vibrating surface 602 is used to generate stereo audio sounds. In these and other embodiments, maximizing differences between the first vibrational energy and the second vibrational energy may comprise applying a gradient descent (e.g., cost function) algorithm. Other suitable algorithms besides gradient descent may also be used.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A system comprising:

a vibrating surface;

a first mechanical transducer mechanically coupled to the vibrating surface;

a second mechanical transducer mechanically coupled to the vibrating surface at a location different than that of the first mechanical transducer;

a first signal path for driving the first mechanical transducer, wherein the first signal path comprises a first amplifier and a first filter having a first frequency response;

a second signal path for driving the second mechanical transducer, wherein the second signal path comprises a second amplifier and a second filter having a second frequency response; and a control subsystem comprising:

an analysis block configured to cross-correlate a first vibrational energy at a first location of the vibrating surface with a second vibrational energy at a second location of the vibrating surface; and a coefficient control block configured to adaptively modify at least one of the first frequency response and the second frequency response responsive to cross-correlation of the first vibrational energy and the second vibrational energy in order to maximize differences between the first vibrational energy and the second vibrational energy.

2. The system of claim 1, wherein the vibrating surface comprises a display screen of an electronic device.

3. The system of claim 1, further comprising:

a first sensor coupled to the vibrating surface configured to sense the first vibrational energy; and a second sensor coupled to the vibrating surface configured to sense the second vibrational energy.

4. The system of claim 3, wherein:

the first sensor is coupled to the vibrating surface proximate to the first mechanical transducer; and the second sensor is coupled to the vibrating surface proximate to the second mechanical transducer.

5. The system of claim 1, wherein the first mechanical transducer is configured to sense the first vibrational energy.

6. The system of claim 5, wherein the second mechanical transducer is configured to sense the second vibrational energy.

7. The system of claim 1, wherein at least one of the first mechanical transducer and the second mechanical transducer comprises a piezoelectric transducer.

8. The system of claim 1, wherein:

the first frequency response has variable magnitude and variable phase controlled by the coefficient control block; and the second frequency response has variable magnitude and variable phase controlled by the coefficient control block.

9. The system of claim 1, wherein maximizing differences between the first vibrational energy and the second vibrational energy comprises maximizing a magnitude of the first vibrational energy and minimizing a magnitude of the second vibrational energy.

10. The system of claim 1, wherein maximizing differences between the first vibrational energy and the second vibrational energy comprises minimizing a cross-correlation between the first vibrational energy and the second vibrational energy.

11. The system of claim 1, wherein maximizing differences between the first vibrational energy and the second vibrational energy comprises applying a gradient descent algorithm.

12. The system of claim 1, wherein adaptively modifying at least one of the first frequency response and the second frequency response responsive to cross-correlation of the first vibrational energy and the second vibrational energy in order to maximize differences between the first vibrational energy and the second vibrational energy results in adaptive localization of vibrational energy.

13. A method comprising:

cross-correlating a first vibrational energy at a first location of a vibrating surface with a second vibrational energy at a second location of the vibrating surface; and adaptively modifying at least one of a first frequency response and a second frequency response responsive to cross-correlation of the first vibrational energy and the second vibrational energy in order to maximize differences between the first vibrational energy and the second vibrational energy;

wherein:

the first frequency response is that of a first filter integral to a first signal path for driving a first mechanical transducer mechanically coupled to the vibrating surface, the first signal path comprising a first amplifier and the first filter; and the second frequency response is that of a second filter integral to a second signal path for driving a second mechanical transducer mechanically coupled to the vibrating surface at a location different than that of the first mechanical transducer, the second signal path comprising a second amplifier and the second filter.

14. The method of claim 13, wherein the vibrating surface comprises a display screen of an electronic device.

15. The method of claim 13, further comprising:

sensing the first vibrational energy with a first sensor coupled to the vibrating surface; and sensing the second vibrational energy with a second sensor coupled to the vibrating surface.

16. The method of claim 15, wherein:

the first sensor is coupled to the vibrating surface proximate to the first mechanical transducer; and the second sensor is coupled to the vibrating surface proximate to the second mechanical transducer.

17. The method of claim 13, further comprising sensing the first vibrational energy with the first mechanical transducer.

18. The method of claim 17, further comprising sensing the second vibrational energy with the second mechanical transducer.

19. The method of claim 13, wherein at least one of the first mechanical transducer and the second mechanical transducer comprises a piezoelectric transducer.

20. The method of claim 13, wherein:

the first frequency response has variable magnitude and variable phase;

the second frequency response has variable magnitude and variable phase; and adaptively modifying at least one of the first frequency response and the second frequency response comprises controlling the variable magnitude and variable phase of the first frequency response and the variable magnitude and variable phase of the second frequency response.

21. The method of claim 13, wherein maximizing differences between the first vibrational energy and the second vibrational energy comprises maximizing a magnitude of the first vibrational energy and minimizing a magnitude of the second vibrational energy.

22. The method of claim 13, wherein maximizing differences between the first vibrational energy and the second vibrational energy comprises minimizing a cross-correlation between the first vibrational energy and the second vibrational energy.

23. The method of claim 13, wherein maximizing differences between the first vibrational energy and the second vibrational energy comprises applying a gradient descent algorithm.

24. The method of claim 13, wherein adaptively modifying at least one of the first frequency response and the second frequency response responsive to cross-correlation of the first vibrational energy and the second vibrational energy in order to maximize differences between the first vibrational energy and the second vibrational energy results in adaptive localization of vibrational energy.

* * * * *